US005960473A

United States Patent [19]

Tajima

[11] Patent Number: 5,960,473

[45] Date of Patent: Oct. 5, 1999

[54] SPORTSWEAR

[75] Inventor: Kazuhiko Tajima, Tokyo, Japan

[73] Assignee: Kabushiki Kaisha Phenix, Tokyo, Japan

[21] Appl. No.: 08/972,442

[22] Filed: Nov. 18, 1997

[30] Foreign Application Priority Data

Feb. 28, 1997 [JP] Japan ..... 9-001191

[51] Int. Cl.[6] ..... A41B 1/12; A41D 1/06; A41D 27/10

[52] U.S. Cl. ..... 2/69; 2/79; 2/227; 2/230; 2/269

[58] Field of Search ..... 2/69, 71, 69.5, 2/227, 230, 269, 270, 217, 275, 455, 79

[56] References Cited

U.S. PATENT DOCUMENTS

| | | |
|---|---|---|
| 172,072 | 1/1876 | Baker . |
| 212,271 | 2/1879 | Schollian . |
| 228,246 | 6/1880 | Carney . |
| 234,427 | 11/1880 | Plympton . |
| 461,434 | 10/1891 | Henry . |
| 560,683 | 5/1896 | Bruckner . |
| 614,158 | 11/1898 | Barbour . |
| 1,049,062 | 12/1912 | Dubbs . |
| 1,105,355 | 7/1914 | Leighton . |
| 1,242,777 | 10/1917 | Danielson . |
| 1,246,044 | 11/1917 | Bloomenthal . |
| 1,421,162 | 6/1922 | Buckley . |
| 1,652,750 | 12/1927 | Wohlgemuth . |
| 1,793,708 | 2/1931 | Martin . |
| 1,896,183 | 2/1933 | Manson . |
| 1,934,179 | 11/1933 | Fischer . |
| 1,935,296 | 11/1933 | Joyce . |
| 2,127,763 | 8/1938 | Bentz . |
| 2,153,068 | 4/1939 | Arden . |
| 2,216,852 | 10/1940 | McMeekin . |
| 2,292,227 | 8/1942 | Kopyto . |
| 2,318,924 | 5/1943 | Cohn . |
| 2,431,811 | 12/1947 | Lang . |
| 2,524,814 | 10/1950 | Leaf . |
| 2,687,530 | 8/1954 | Farnum . |
| 2,692,988 | 11/1954 | Rouse . |
| 2,876,456 | 3/1959 | Johnson . |
| 3,665,516 | 5/1972 | Orovan . |
| 4,149,275 | 4/1979 | Sanchez . |
| 4,573,218 | 3/1986 | Saggs . |
| 5,299,323 | 4/1994 | Schaefer et al. . |
| 5,546,606 | 8/1996 | Luckabaugh . |
| 5,617,581 | 4/1997 | Robbins . |

*Primary Examiner*—John J. Calvert
*Assistant Examiner*—Shirra L. Jenkins
*Attorney, Agent, or Firm*—Armstrong, Westerman, Hattori, McLeland & Naughton

[57] ABSTRACT

In a sportwear, especially ski wear of the type that pants are suspended with suspenders, length of the leg portions of the pants are formed extendably and contractably. Front ends of the suspenders are fixed to the front face of the waist portion W of the pants, while rear ends of the suspenders are fixed in a narrow width to a back support piece attached to the back face of the waist portion and having a length from the waist portion up to the neck portion. Thus the suspenders are prevented from slipping off from the shoulders.

11 Claims, 18 Drawing Sheets

SPORTSWEAR

FIELD OF INVENTION

This invention relates to sportwears, especially ski wear for children of the type that a pair of pants are suspended by suspenders to prevent the pants from slipping down and that length of limb portions can be adjusted according to individual figures.

BACKGROUND OF THE INVENTION

There has been ski wear as shown in the attached drawings, FIGS. 20 and 21. A user wears the pants a adjusting the wearing position according to his height employing suspenders b. Front or back ends of the suspenders are detachably fixed to the front or the back of a waist portion W of the pants by means of clips c, c.

A ski wear of so-called jumpsuit type wherein a jacket portion d is integrally formed with pants a as shown in FIGS. 22 and 23 has been popular because of its wind breaking and warmth keeping properties. Some of the ski wear of this type also employ suspenders b whose front or back ends are attached to the pants by means of clips c, c.

In both types of the ski wear as shown in FIGS. 20 and 21; and FIGS. 22 and 23, a number of sizes have to be manufactured for a user to choose a size most suitable to his height and figure.

Conventionally, the user was likely to choose a suit of rather big size to leave spaces around his body. Especially children tend to wear too big suits because their heights and figures grow faster than adults.

However, the pants a are often slackened and so, uncomfortable to wear and hinder the wearer's movement. The pants a therefore, are suspended with suspenders b stretched on his shoulders. However, the suspenders are apt to slip off the shoulders while the wearer is skiing, and he has to stop skiing to position the suspenders. This causes unnecessary trouble and a loss of time.

In case of the jumpsuit type ski wear as shown in FIGS. 22 and 23 of which the upper half portion d is connected with the lower half portion a, the trouble is more serious than the type shown in FIGS. 20 and 21, because the upper half portion d must be opened or taken off to readjust the slipped-off suspenders on the shoulders. It is difficult especially for children to position the suspenders on the shoulders by themselves.

It is an object of this invention to solve such inconveniences of the conventional sportwears as abovementioned, to prevent suspenders from slipping off from shoulders, thereby avoiding unnecessary trouble and saving time for re-adjusting position of the suspenders so that skiing or work may not be interrupted.

It is another object of this invention to provide means for adjusting the length of limb portions of sportswear according to the length of the users limbs and enhance adaptability and workability of the sportwears.

SUMMARY OF THE INVENTION

These objects can be solved by providing sporstwear comprising suspenders whose front and rear ends are attached respectively to a front and a back face of a waist portion of pants, and means for adjusting the length of leg portions of the pants extendably and contractably, a back support piece being attached by sewing to the back face of the waist portion, front ends of said suspenders being fixed to the front face of the waist portion while rear ends of said suspenders being fixed in a narrow width to said back support piece.

According to another aspect of this invention, said back support piece is formed in substantially elongated bell shape having a length corresponding to a wearer's back from his waist portion up to neck portion.

According to still another aspect of this invention, said suspenders are detachably engaged with a pair of front support pieces or said back support piece by sewing or by means of clips.

According to a further aspect of this invention, said pants are of salopette type.

According to a further aspect of this invention, a jacket portion is integrally formed with said pants.

According to a further aspect of this invention, means for adjusting length of the leg portions of the pants comprise at least one tunnel cloth portion provided on each leg of the pants and one tunnel cloth portion provided around a waist portion connected with each other, further comprise strings passing through said tunnel cloth portions, each said string being fixed at its one end to a lower end of each the tunnel cloth portion on the leg portion, and pulled outward from end of the tunnel cloth portion for the waist portion and then fastened up, and support members provided at junctions of the tunnel cloth portions on the leg portions and waist portions for enabling said strings to be pulled smoothly.

According to a further aspect of this invention, at least one tunnel cloth portion is provided along each of the legs, one end of the string being fixed to one end of said tunnel cloth portion and the other end being fastened up at the other end of the tunnel cloth portion at a desired position of the string.

According to a further aspect of this invention, said means for adjusting length of the pants legs comprise any of fastening means consisting of open fasteners, buttons and button holes, attachment tapes provided around each leg at an intermediate position of the leg, spacing both edges of the fastening means at a desired distance.

According to a further aspect of this invention, said means for adjusting length of the pants legs comprise a plurality of divisional tubular portions having at least the same diameter as said leg portions, and any of fastening means consisting of open fastners, buttons and button holes and attachment tapes provided between the respective divisional tubular portions and between the leg portions and the divisional tubular portions thereby detachably connecting the divisional tubular portions with the leg portions.

According to a further aspect of this invention, the pants comprise fastening means provided between the two leg portions from their bottom to the top thereby allowing the pants to be opened and closed under the legs.

According to a further aspect of this invention, the pants further comprise an inner backing cloth attached to the back face of each the leg portion below knee position, said inner backing cloth having a rectangular shape in developed state and a height substantially corresponding to length of the leg and being adapted to be opened and closed.

According to a further aspect of this invention, an upper edge of said inner backing cloth is fixed by sewing to the back face of each the leg portion under the knee position while its lower edge is formed with a rubber con taining tightening band provided with fastening means at both ends thereof.

According to a further aspect of this invention, there is provided a sportswear which comprises tunnel cloth portions provided along both sleeves of the jacket portion, and strings each fixed at its one end to one end of each the tunnel cloth protion and fastened up at its other end at a desired position to the other end of each the tunnel cloth portion thereby adjusting length of the sleeves.

According to a yet further aspect of this invention, there is provided a sportswear which comprises any one of fastening means consisting of an open fastner, button and button holes, and attachment tape, provided along each sleeve of the jacket portion at its intermediate position with a desired spacing between both edges of the fastening means, thereby adjusting length of the sleeve.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
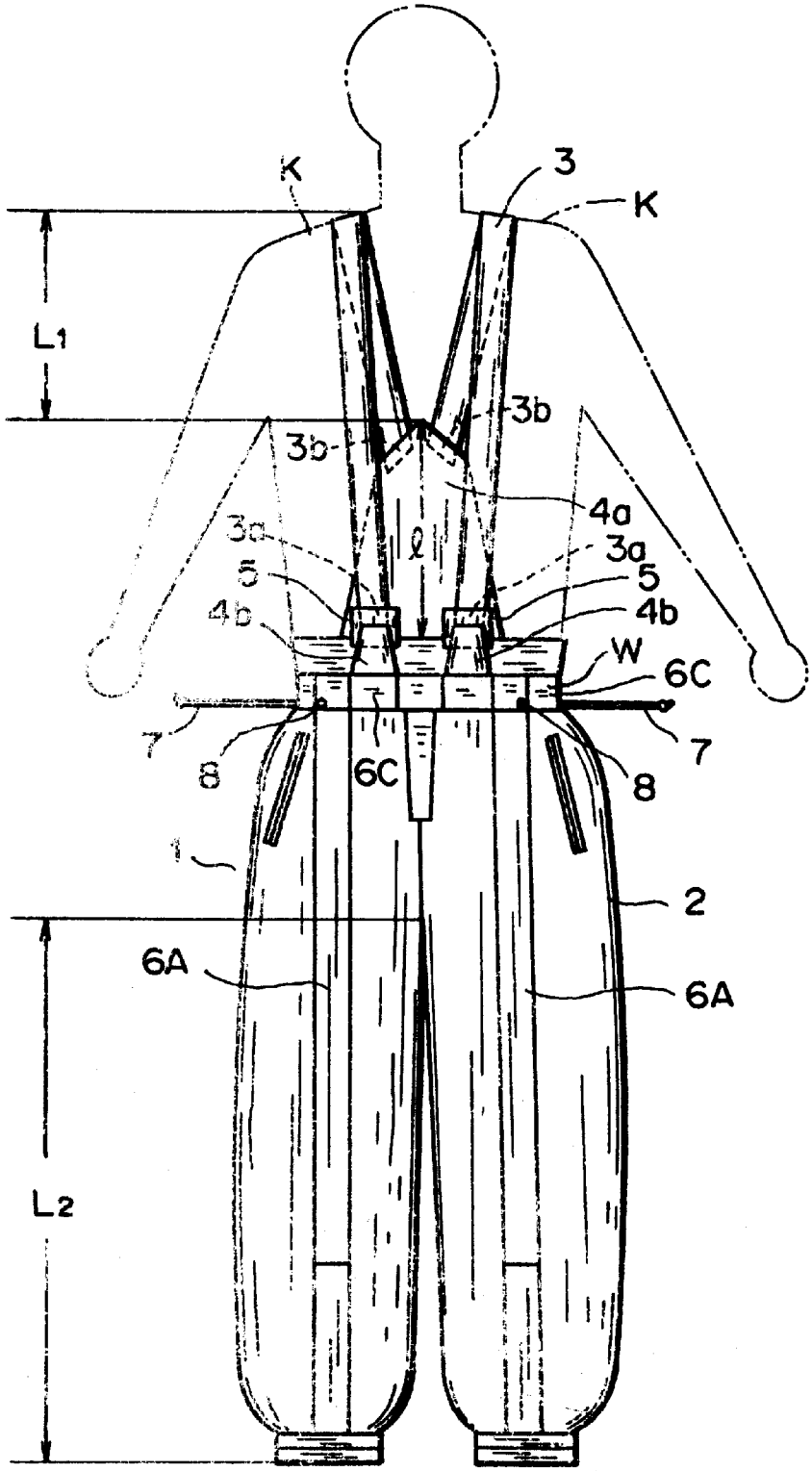
FIG. 1 is a front view of a sportswear of a preferred embodiment according to this invention.

Referring now to the drawings, FIGS. 1–6 show a preferred embodiment of this invention.

Reference numeral 1 is a sportswear comprising overall pants 2. The pants as a whole are not limited to such a design as illustrated here, but there are a variety of designs.

Numeral 3 denotes suspenders whose front ends 3*a*, 3*a* and rear ends 3*b*, 3*b* are fixed respectively to the front and back of the pants 2 at their waist portion W. The suspenders 3 are stretched on the wearer's both shoulders K, K thereby to pull the pants 2 upwards. The suspenders 3 are formed of strips of knitted cloth, rubber cords or the like and are so constructed that their length can be adjusted according to a size of the wearer's torso.

Figure 2:
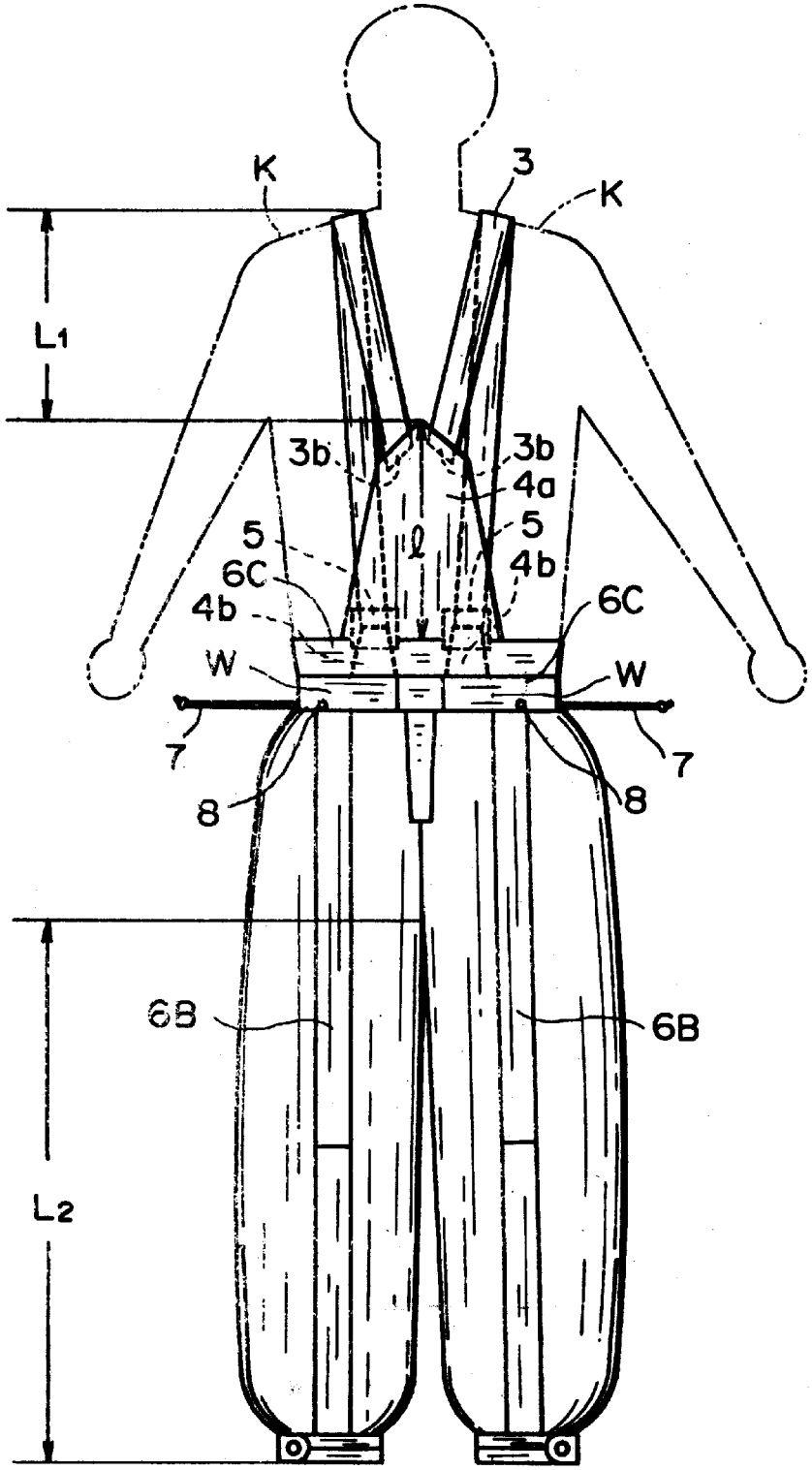
FIG. 2 is a rear view of the sportswear of FIG. 1.
Figure 6:
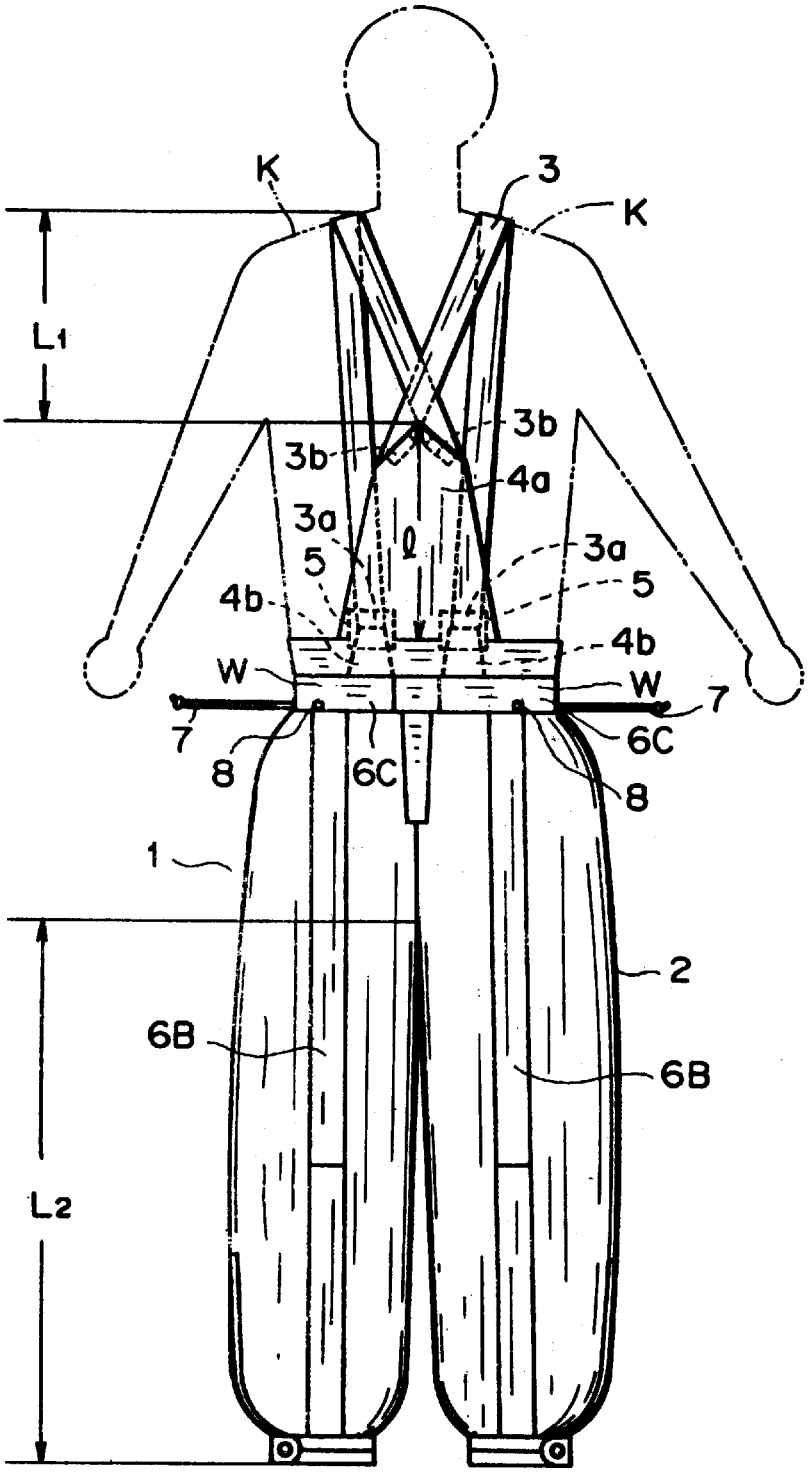
FIG. 6 is a rear view of a sportswear with suspenders fixed in a different manner.

In this embodiment, a back support piece 4*a* of elongated bell-shape having a length 1 corresponding to the length from the wearer's waist to the neck is attached by sewing to the back of the waist portion W of the pants 2 as shown in FIGS. 1 and 2. The support piece 4*a* is made of a cloth for example, having good water repellency, elasticity, warmth retaining property and permeability. To the front of the waist portion W of the pants 2 are attached by sewing a pair of front support pieces 4*b*, 4*b*. The front ends 3*a*, 3*a* of the suspenders 3 are fixed to said front support pieces 4*b*, 4*b* by means of clips 5, 5 detachably and adjustably, or without using-clips 5,5. The back ends 3*b*, 3*b* of the suspenders 3 are fixed to the back support piece 4*a* directly or by means of clips (not shown) similar to said clips 5, 5 detachably and adjustably The back ends 3*b*, 3*b* may be fixed to the back support piece 4*a* either in a bifurcated shape as shown in FIG. 2 or in an X-shape as shown in FIG. 6. Because length L1 from the position where the ends 3*b*, 3*b* are fixed to the support piece 4*a* to the wearer's shoulders K, K is set short and the ends 3*b*, 3*b* are close to each other, the suspenders are prevented from slipping off the shoulders K, K and so, time and trouble to re-adjust the suspenders can be saved.

As described above, even pants of a larger size leaving some spaces around the wearer's body can be comfortably worn without slacking on the body and so, pressure or tightness which would hinder the wearer's movement can be avoided.

Further, because the back support piece 4*a* stably abuts the wearer's back, the suspenders 3 fixed to the support piece 4*a* at their back ends 3*b*, 3*b* would not accidentally move and tangle. Moreover, the support piece 4*a* removes such inconvenience as the suspenders 3 pull the pants 2 too tightly. Due to its elasticity, the support piece 4*a* is easily stretched and follows the wearer's move ments.

Numeral 6A represents a tunnel cloth portion provided near a knee position in front of each leg of a overall pants embodying this invention to constitute means for adjusting length of the leg. Numeral 6B represents a tunnel cloth portion provided at a similar position in rear of each leg of the pants. Numeral 6C represents a tunnel cloth portion provided on the waist portion W. Strings 7 are provided to pass through both the tunnel cloth portions 6A, 6B on the legs and the tunnel cloth portion 6C on the waist. At junctions of the tunnel cloth portions 6A, 6B and 6C are provided support members 8 such as rollers of synthetic resin, etc. to reduce abrasion for enabling the string 7 to be pulled outward smoothly.

Figure 3:
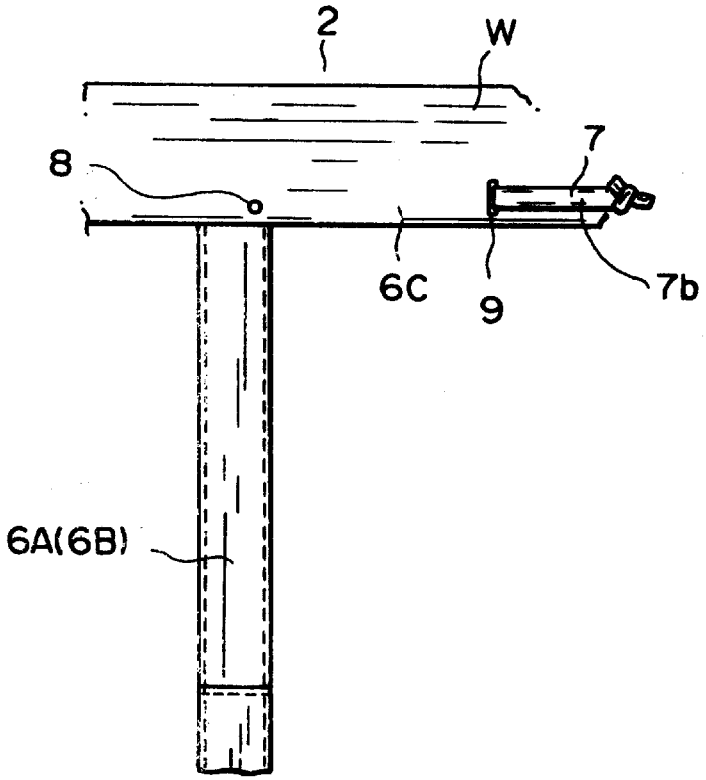
FIG. 3 is an expanded view of a tunnel cloth portion of the sportswear.
Figure 4:
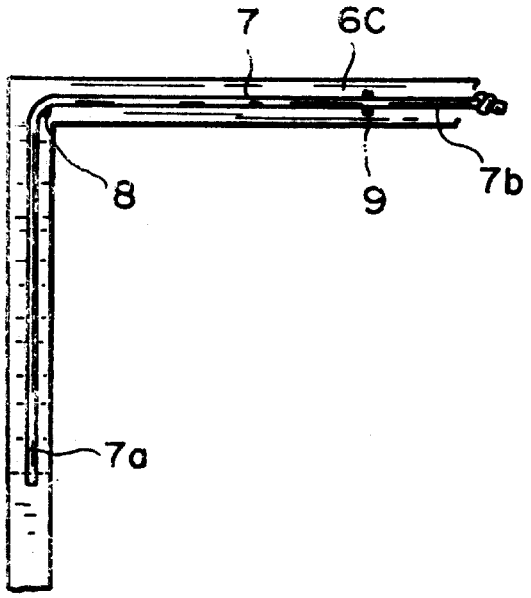
FIG. 4 is an exploded view of the tunnel cloth portion.

The structure of the tunnel cloth portion is illustrated in FIGS. 3 and 4. The tunnel cloth portions 6A, 6B on the legs and the tunnel cloth portion 6C on the waist are connected at substantially right angle. The strings 7 passing through the tunnel cloth portions are fixed by sewing at their one ends 7*a* to the lower ends of the tunnel cloth portions 6A, 6B while the other ends 7*b* of the strings 7 are guided outwardly from openings 9 formed in the tuneel cloth portions 6C at the waist portion W.

Figure 5:
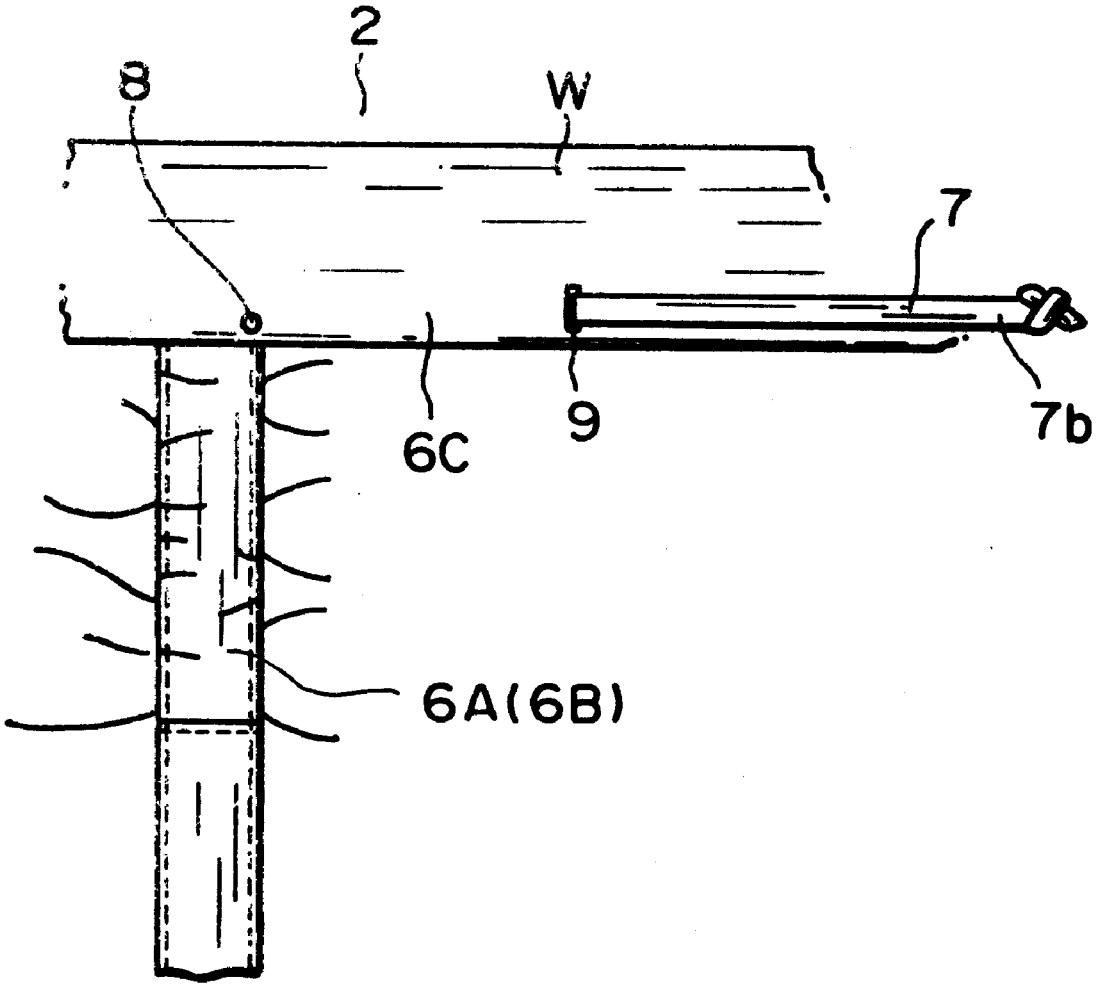
FIG. 5 is an expanded view of the tunnel cloth portion in a squeezed state.

When the strings 7 are pulled from the outside as shown in FIG. 5, the tunnel cloth portions 6A, 6B are contracted preferentially to the tunnel cloth portions 6C by means of the support members 8 thereby to adjust length L2 of the legs of the pants 2 according to length of the wearer's legs. A size of the waist portion W is simultaneously adjusted according to a size of the wearer's waist. The strings 7 are fastened up by means of appropriate fastening means such as buckles or fastners to prevent accidental release of the strings after the length of the legs and the size of the waist portions of the pants have been set.

Thus the wearer can adjust the length L2 of the legs of the pants 2 by drawing the strings passing through the tunnel cloth portions 6A, 6B and fixed at their one ends according to the length of his legs, and at the same time can adjust the waist portion W of the pants 2 according to the size of his waist.

Therefore, even if adults of individually different sizes have purchased sportswears of rather larger size, they can adjust the length L2 of the legs of the pants 2 as well as the size of the waist portion W by drawing the strings 7. This can reduce variety of sizes of the sportwears to be manufactured. The sportswears according to this invention is most suitable for children who rapidly grow in height and figure and have physical difference from one another.

Figure 7:
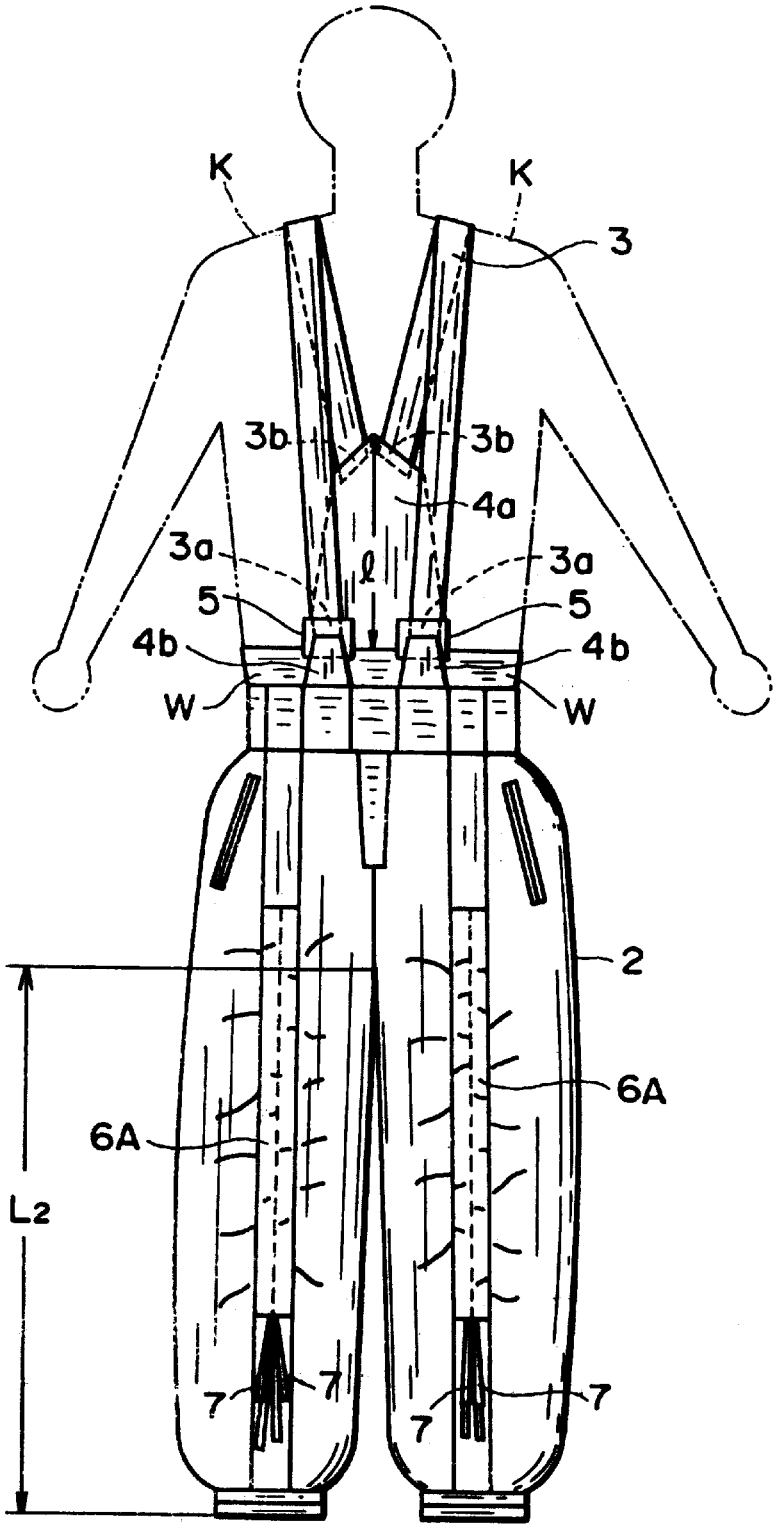
FIG. 7 is a front view of the sportswear of the second embodiment of this invention.
Figure 8:
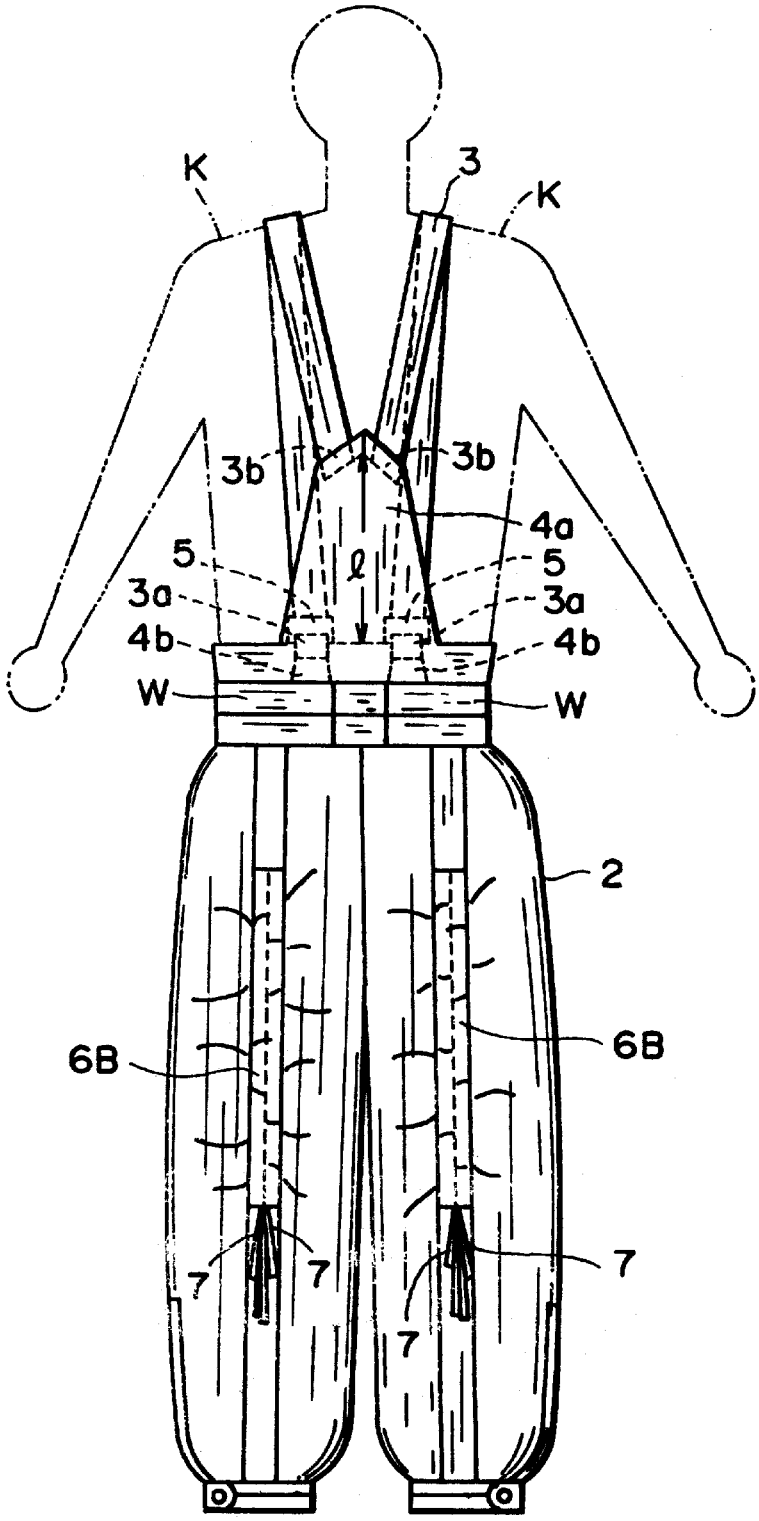
FIG. 8 is a rear view of the sportswear of FIG. 7.
Figure 9:
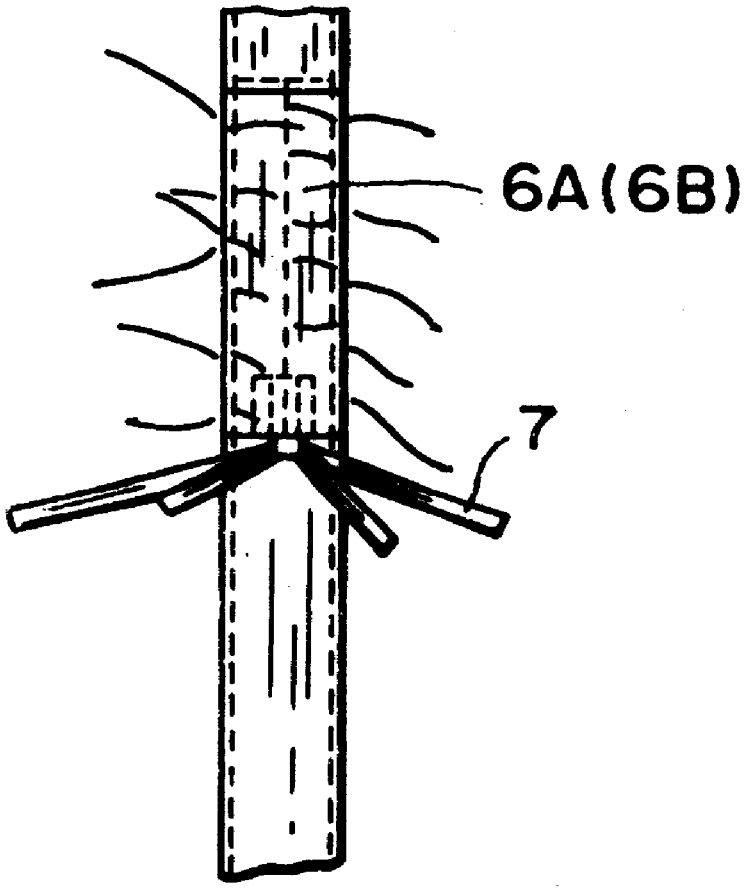
FIG. 9 is an enlarged front view of the tunnel cloth portion according to this invention.

FIGS. 7, 8 and 9 show the second embodiment according to this invention, in which the means for extending and contracting length of the legs of the pants 2 are tunnel cloth portions 6A, 6B only provided along the both legs in front and rear of the pants 2. The string 7 fixed at its one end to each end of the tunnel cloth portions 6A, 6B passes through the tunnel cloth portions and is fastened up at the other end of the portions 6A, 6B at a desired length by suitable fastening means thereby to adjust the length L2 of the pants legs. Further, the rear ends 3*b*, 3*b* of the suspenders 3 are fixed to the back support piece 4*a* in a narrow width similarly to the first embodiment, thereby to prevent the suspenders 3 from slipping off from the wearer's shoulders K, K.

Figure 10:
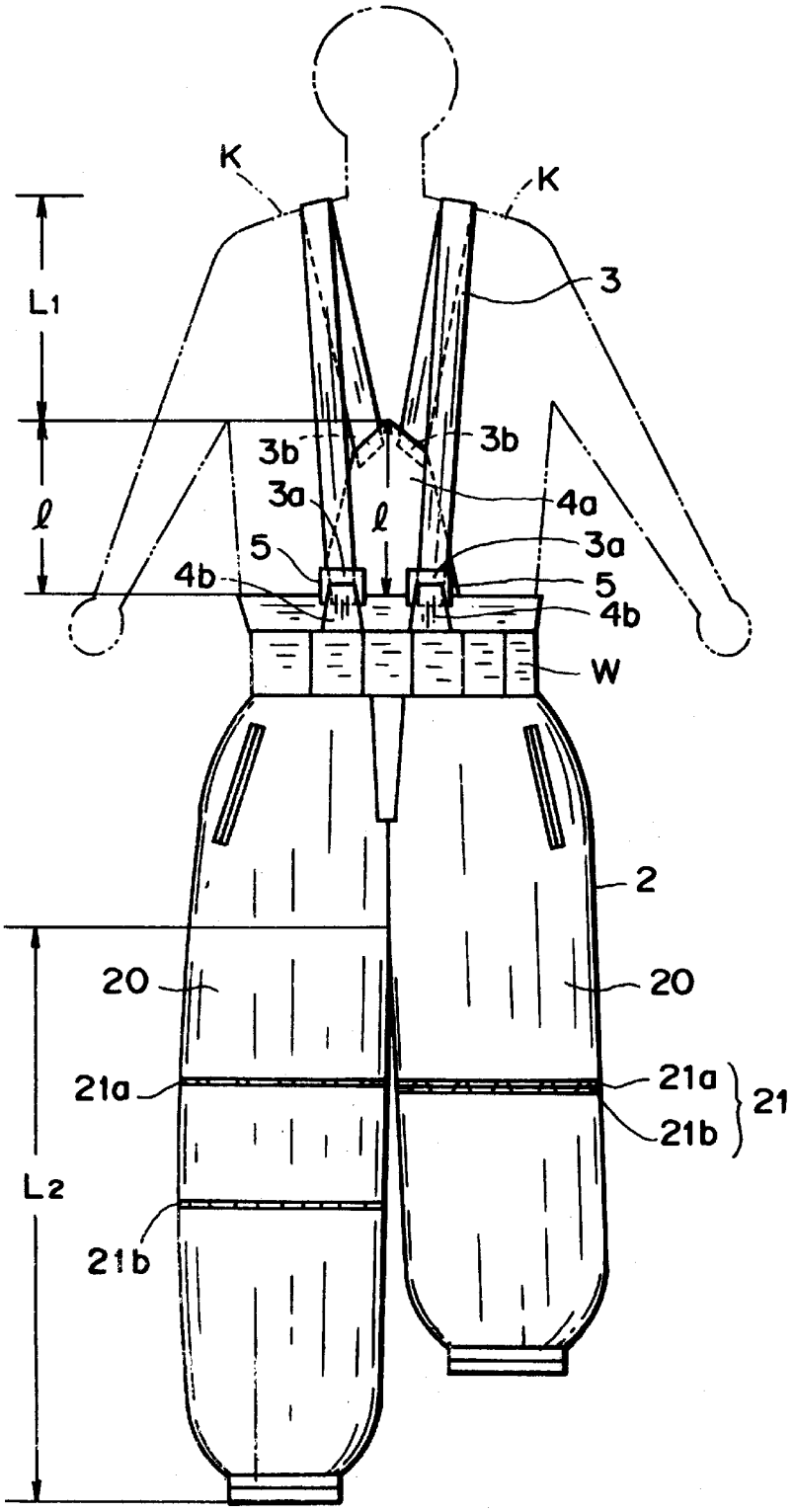
FIG. 10 is a front view of a sportswear of the third embodiment according to this invention.
Figure 11:
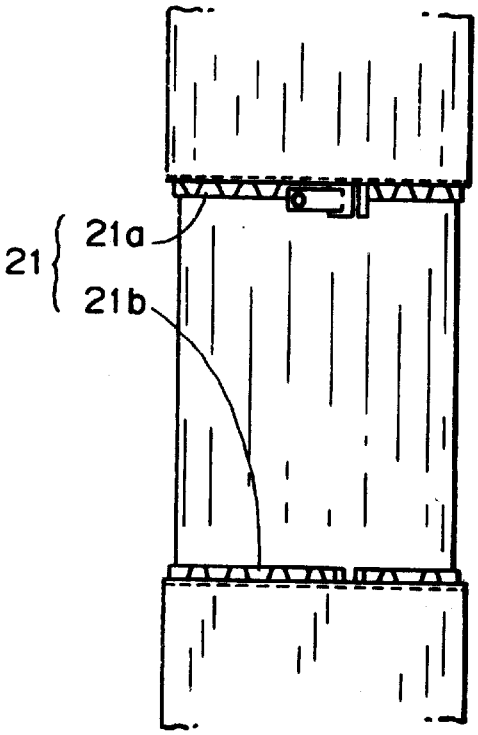
FIG. 11 is an enlarged front view partly cut away of a fastner provided as means for adjusting length of leg portions of the pants according to this invention shown in an open position.
Figure 12:
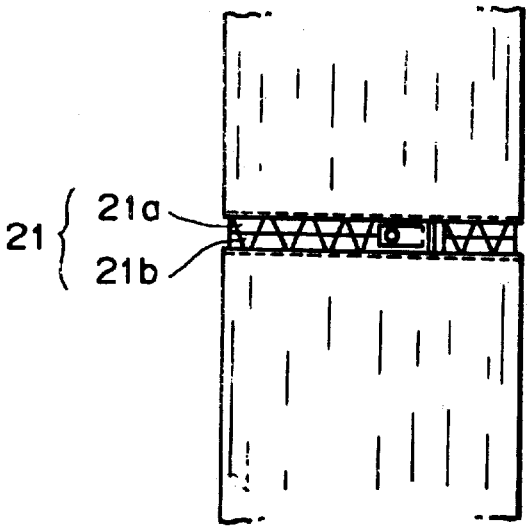
FIG. 12 is an enlarged front view partly cut away of the fastner for adjusting length of the pants' legs shown in FIG. 12 in a closed position.

FIGS. 10, 11 and 12 show the third embodiment of this invention, in which open fasteners 21, 21 are employed as means for adjusting length of the both legs 20, 20 of the pants 2. Both edges 21*a*, 21*b* of the fastener 21 are fixed to the periphery of the leg 20 at its middle portion spacing a desired distance, thereby to adjust the length L2 of the pants legs according to the length of the wearer's legs by engaging and disengaging the open fasteners 21, 21. The open fastener is shown here only by way of example, but some other fastening means such as buttons and button holes, attachment tapes, etc. can be used.

Figure 13:
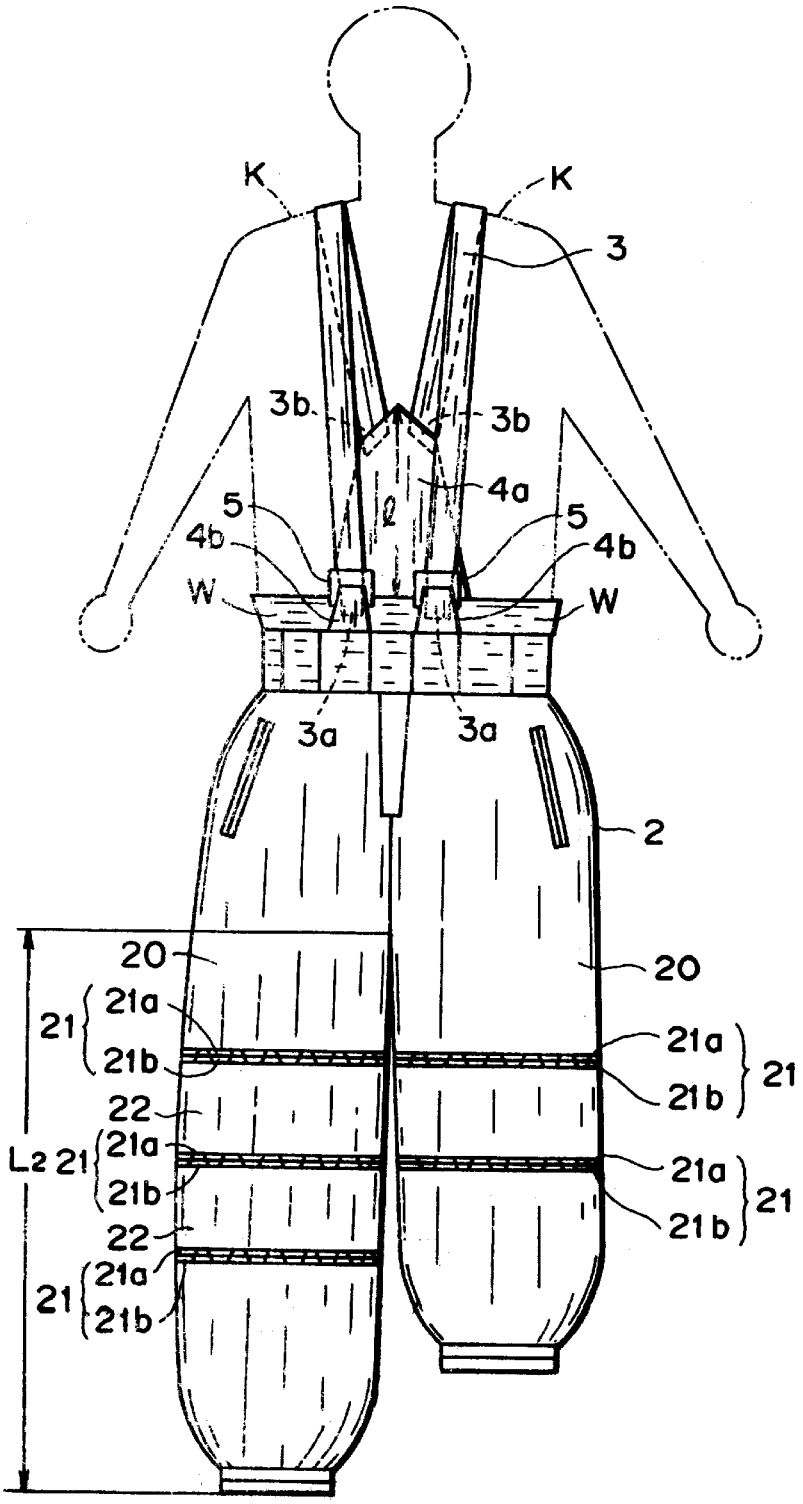
FIG. 13 is a front view of a sportswear of the fourth embodiment according to this invention in which means for adjusting length of leg portions of the pants consist of divisional tubular portions and fastners provided at both edges thereof.
Figure 14:
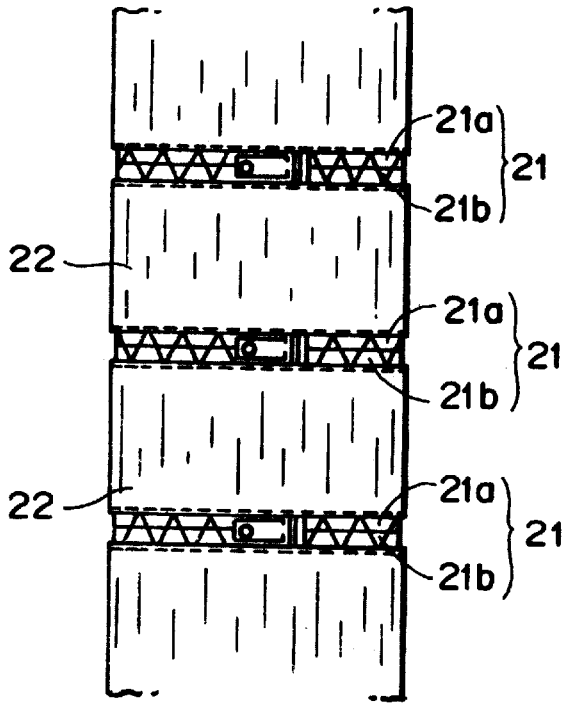
FIG. 14 is an enlarged front view of the pants with their leg portions extended employing the divisional tubular portions of FIG. 13.
Figure 15:
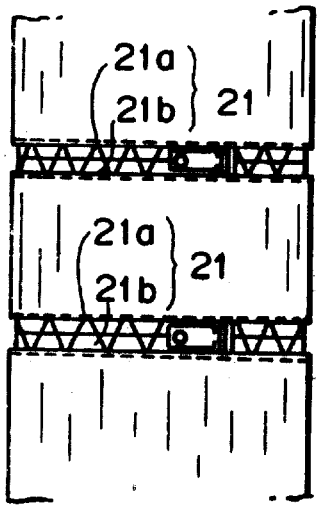
FIG. 15 is an enlarged front view of the pants with their leg portions shortened.

FIGS. 13, 14 and 15 show the fourth embodiment of this invention. This embodiment differs from the third embodiment in that a desired number of divisional tubular portions 22, 22 having at least the same diameter as the leg portions 20, 20 are provided at intermediate positions of the leg portions 20, 20. Between the leg portion 20 and the divisional tubular portion 22, and between the respective divisional tubular portions 22 are provided respective edges 21*a*, 21*b* of open fastners 21, 21 so that the divisional tubular portions 22, 22 can be detachably connected to the leg portions 20, 20. By engaging or disengaging the open fastners 21, 21, the length L2 of the pants legs can be adjusted according to the length of the wearer's legs. Buttons and button holes, attachment tapes can be also employed instead of the open fastners 21 as in the previous embodiment.

Figure 16:
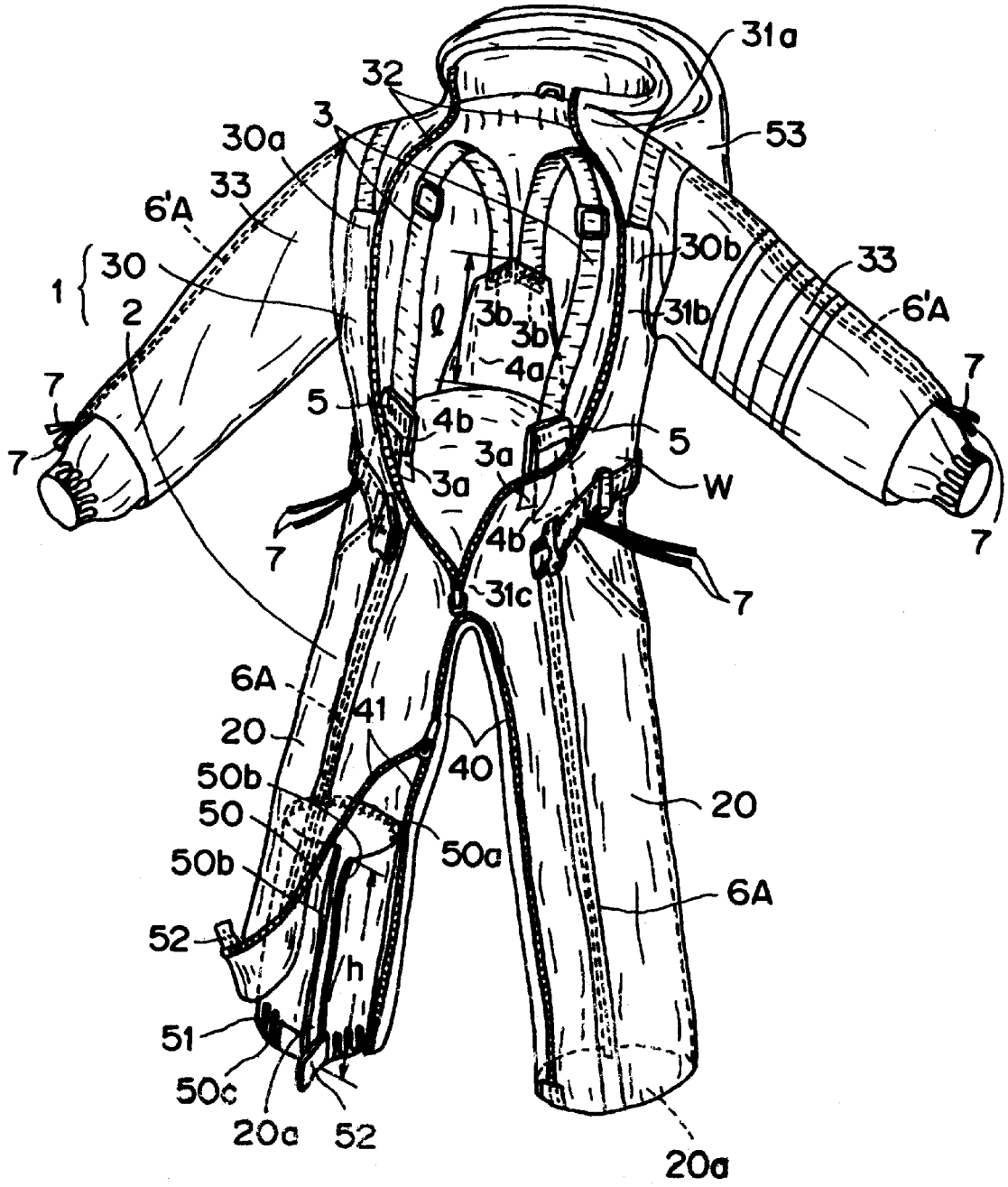
FIG. 16 is a perspective view showing a sportswear of jumpsuit type of the fifth embodiment according to this invention.
Figure 17:
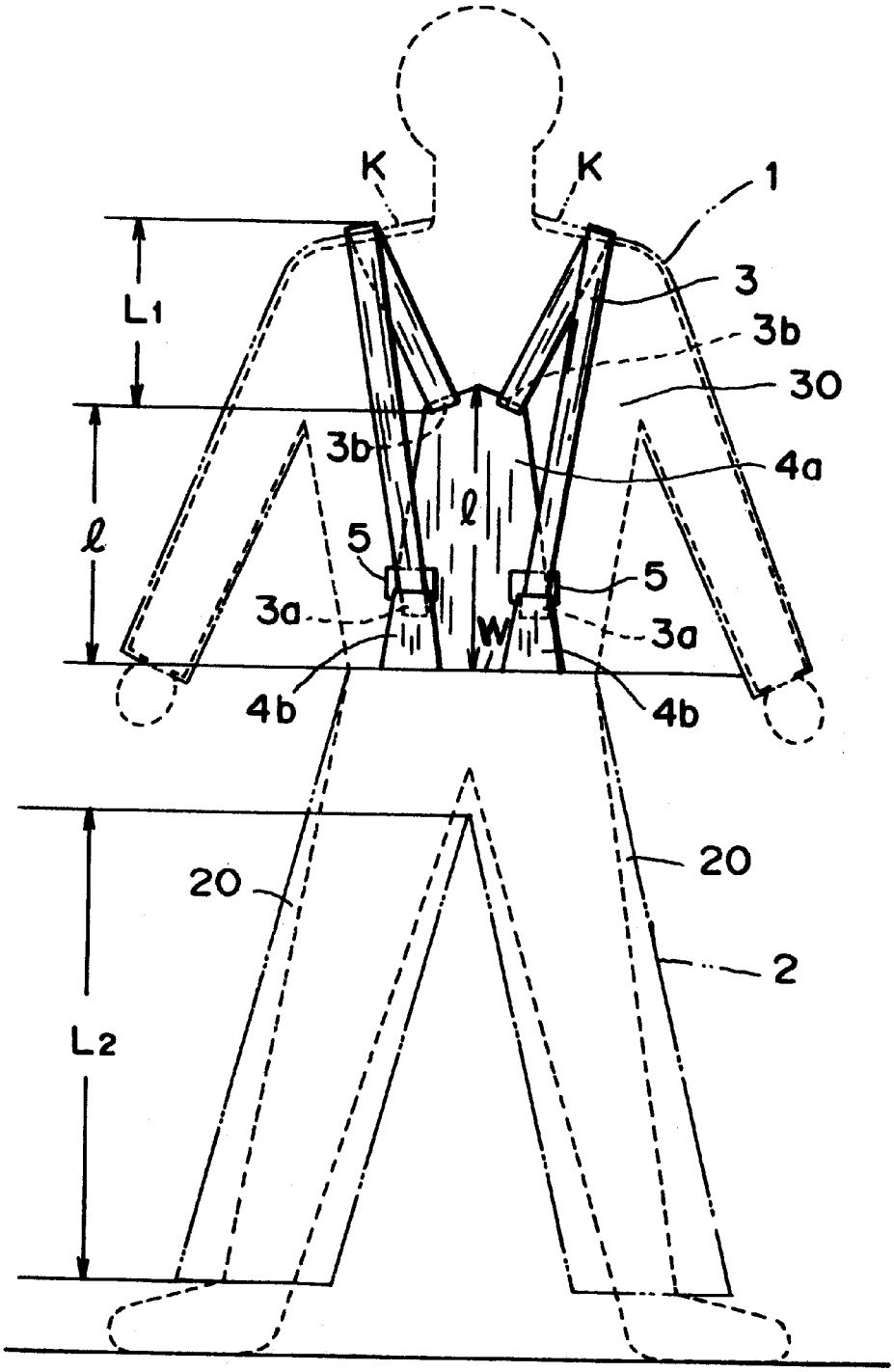
FIG. 17 is a front view of the sportswear shown in FIG. 16 when it is worn.
Figure 18:
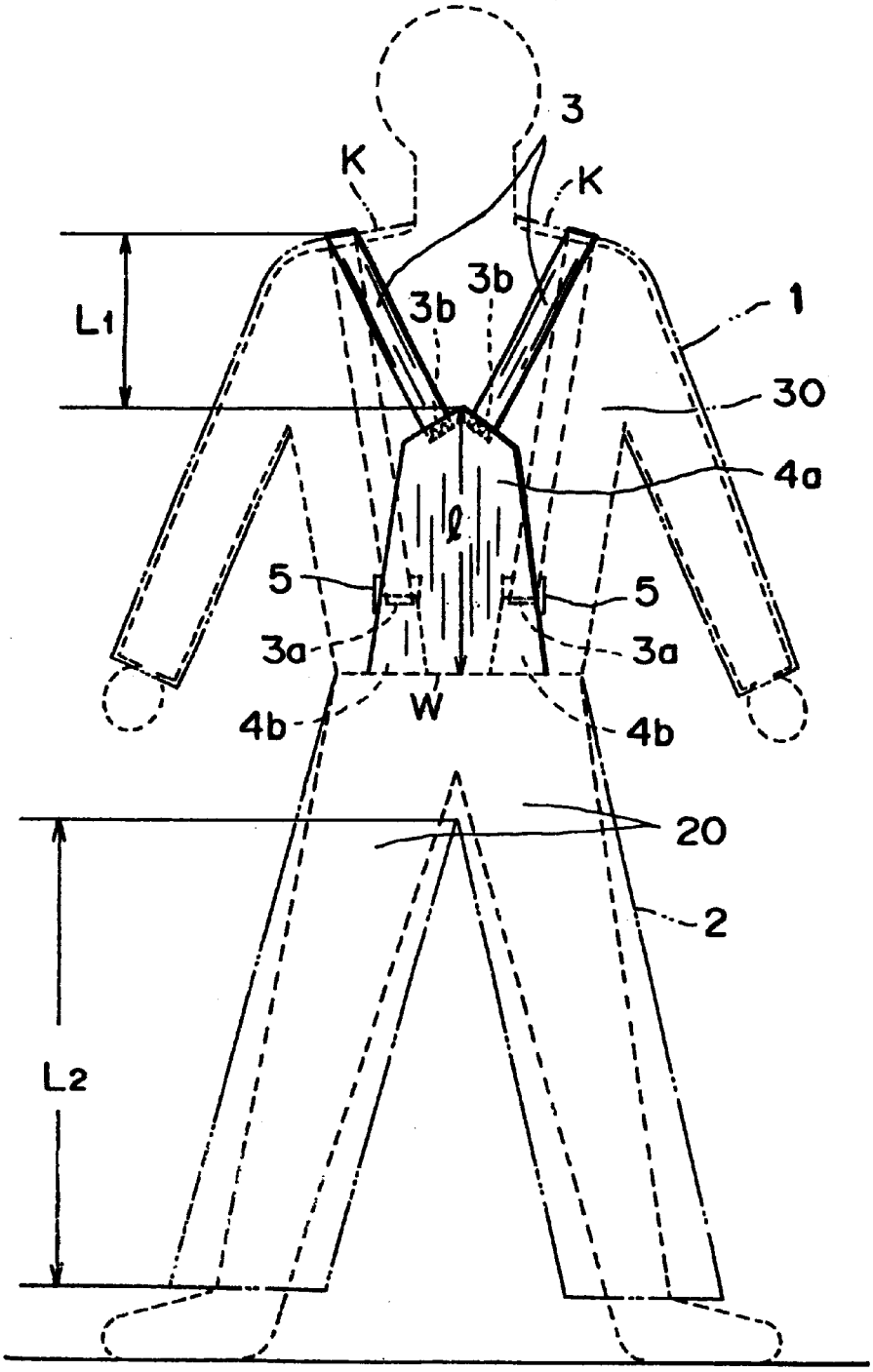
FIG. 18 is a rear view of the above shown in FIG. 17.

FIGS. 16 through 18 show the fifth embodiment illustrating a sportswear of jumpsuits type in which a jacket portion 30 is connected to the pants 2.

The upper fronts 30*a*, 30*b* of the jacket portion 30 are adapted to be opened and closed by suitable fastening means 32 at the front center from a neck 31*a* through a breast 31*b*, to a lower abdomen 31*c*. As the fastening means is employed a fastner 32 in the drawings, but snaps, attachment tape, buttons, etc. can be employed instead of the fastner.

The front ends 3*a*, 3*a* of the suspenders 3 are detachably and contractably connected to the front support pieces 4*b*, 4*b* provided in front of the waist portion W of the pants 2 by means of clips 5, 5, or by sewing. The rear ends 3*b*, 3*b* of the suspenders 3 are fixed to the back support piece 4*a* having a length 1 of elongated bell shape in a narrow width or detachably attached to the back support piece 4*a* by means of clips. Thus, the length L1 of the suspenders 3 from the points connected to the support piece 4*a* to the wearer's shoulders K, K is shortened whereby the suspenders 3 are prevented from slipping off from the shoulders K, K and the pants 2 can be safely worn. Accordingly, as in the first embodiment this saves time and such trouble as the suspenders 3 are accidentally slips off from the shoulders during skiing and the fastener 32 of the jumpsuits must be disengaged to open the fronts 30*a*, 30*b* to position the suspenders 3 on the shoulders.

Further in this embodiment, tunnel cloth portions 6'A, 6'A of the same structure as in the second embodiment are provided along both sleeves 33, 33 of the jacket 30. The string 7 passing through the tunnel cloth portions 6'A is fixed to one end of the tunnel cloth portion 6'A at its one end and fastened up at a desired position at the other end of the tunnel cloth portion 6'A. Thus, the length of the sleeves 33, 33 can be adjusted according to length of the wearer's arms or for necessity of working.

Figure 19:
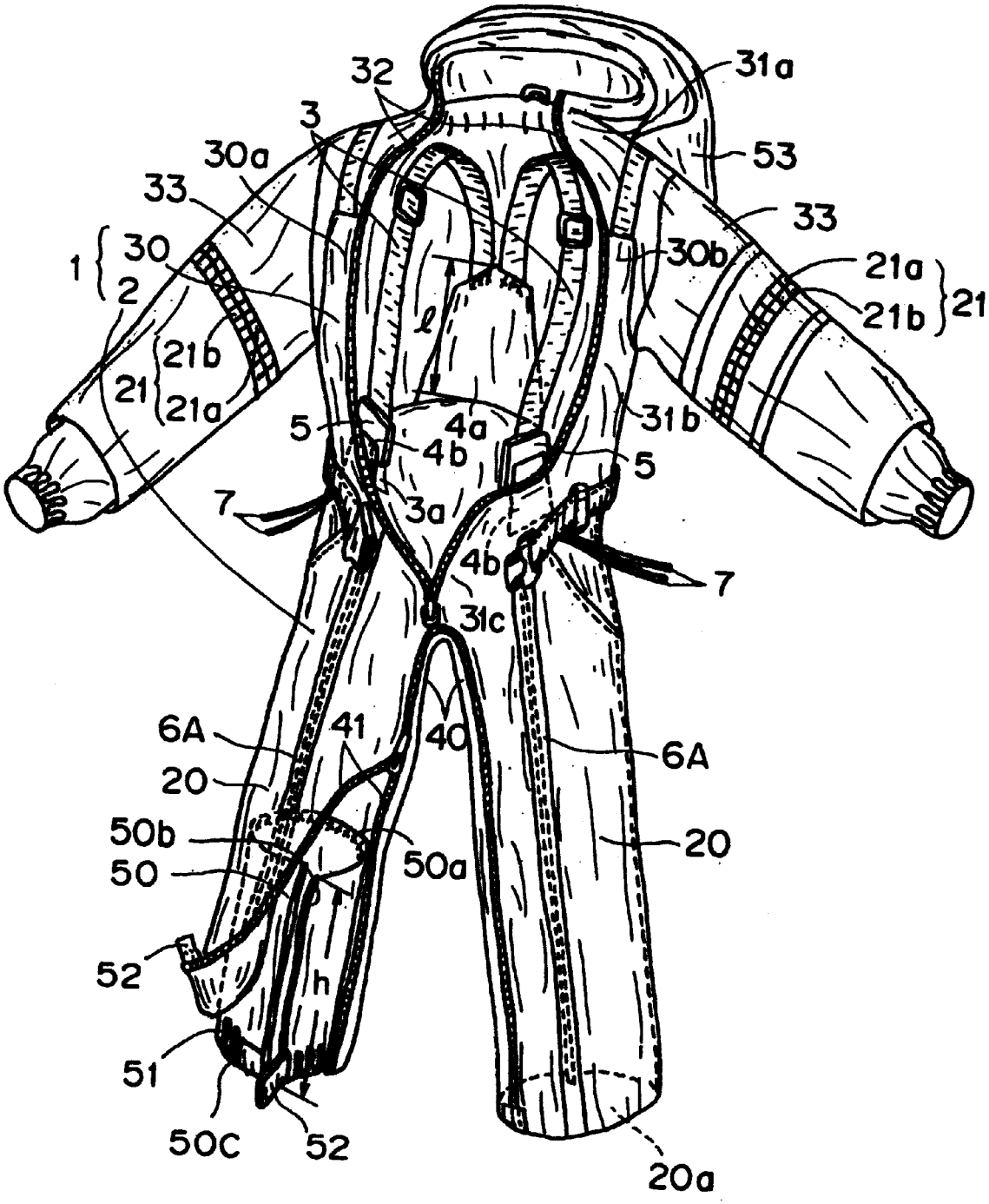
FIG. 19 is a perspective view showing a sportswear of the sixth embodiment according to this invention.
Figure 20:
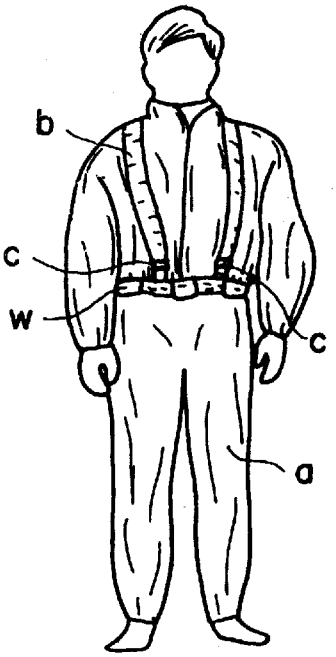
FIG. 20 PRIOR ART
FIG. 20 is a front view of the conventional sportswear of the type that pants are suspended with suspenders.
Figure 21:
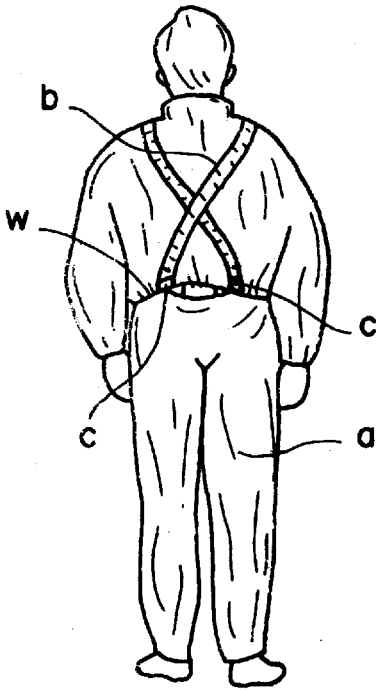
FIG. 21 PRIOR ART
FIG. 21 is a rear view of the above shown in FIG. 20.
Figure 22:
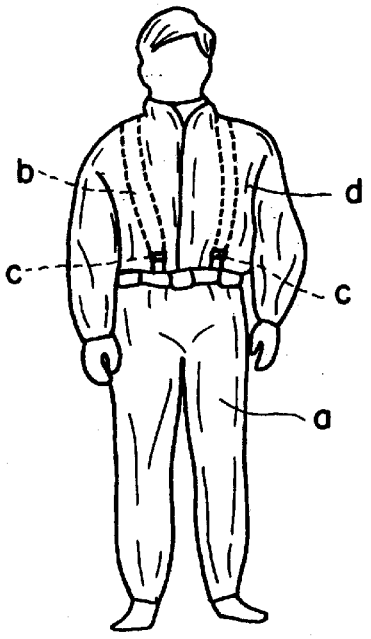
FIG. 22 PRIOR ART
FIG. 22 is a front view of the conventional sportswear of jumpsuit type wherein a jacket portion is integrally formed with pants portion.
Figure 23:
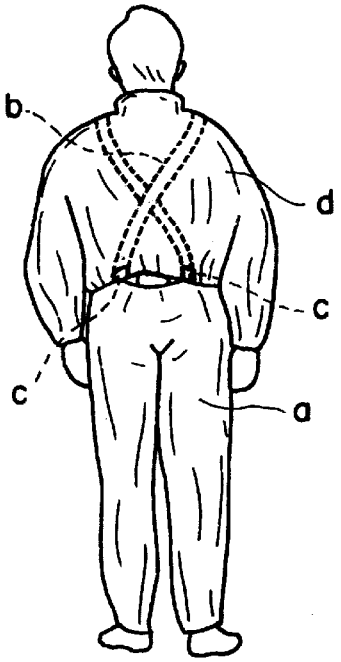
FIG. 23 PRIOR ART
FIG. 23 is a rear view of the above shown in FIG. 22.

FIG. 19 shows a further embodiment according to this invention in which a length of the sleeves 33, 33 of the jacket portion 30 can be adjusted. An open fastener 21 is fixed to the outer circumference of the sleeve with a desired space between both edges 21*a*, 21*b* similarly to the aforementioned third embodiment. With this structure, the sleeve length can be efficiently adjusted by engaging or disengaging the fastener 21.

According to this embodiment, suitable fastening means 41 are provided between the two leg portions 20, 20 from the bottom to the crotch 40, 40 so that the pants 2 can be opened under the legs. Thus for wearing the sportswear, the pants 2 integral with the jacket portion 30 can be worn from the top and then closed by engaging the fastening means 41. The pants 2 can be easily opened under the legs by disengaging the fastening means 41, which makes it easy to put on or take off the pants 2 keeping one's ski shoes or safety shoes on. Especially children can put the jumpsuits on or take them off easily.

Numeral 50 is an inner backing cloth attached to the back face of the leg portion 20 below knee position in a height of h substantially corresponding to length of the leg portion. The inner backing cloth 50 is of rectangular shape in developed state. An upper edge 50*a* is fixed by sewing to the pants legs 20, 20 from their back faces with side edges 50*b*, 50*b* kept open. At a lower edge 50*c* is formed a rubber containing tightening band 51 inside the opening 20*a* of the pants leg 20. Fastening means 52 such as attachment tape as shown in the drawing are provided at both ends of the teightening band 51. Fastening means 52 may be a fastner, button, snap, etc.

By providing the inner leg cloth 50 inside the pants legs 20, 20, wind, snow, etc. are prevented from intruding into the pants 20 through the opening 20*a* of the legs 20. The cloth 50 is formed unclosed at the side edges 50*b*, 50*b* to facilitate the wearer to pull off his legs.

A hood 53 may be integrally formed around the neck of the jacket 30 or may be detachably connected to the jacket by means of a fastner, button, snap or the like.

EFFECT OF THE INVENTION

With the structure of this invention that the length of the arms and legs can be extended and shortened, the wearer can adjust the length of a sportswear according to the length of his arms and legs.

Further, the pants are suspended by means of suspenders with their front ends fixed to the front face of the waist portion of the pants while their rear ends fixed to the back support piece attached to the back of the waist portion from the back to the neck portion. Thus the length of the suspenders from the fixed points up to the shoulders are set short, which obviate slipping off the suspenders from the shoulders. Therefore, the pants can be worn in the most confortable state. The wearer can save time and trouble of interrupting skiing or working for re-adjusting the slipped-off suspenders on his shoulders.

What is claimed is:

1. A sportswear comprising:

pants having a waist portion and leg portions;

suspenders each having a front end and a rear end;

means for adjusting length of said leg portions extendably and contractably; and a back support piece attached by sewing to a back face of said waist portion, wherein said front ends of said suspenders are fixed to a front face of said waist portion while rear ends of said suspenders are fixed to said back support piece, wherein said means for adiusting length of said leg portion includes:

a first tunnel cloth portion provided on said leg portion;

a second tunnel cloth portion provided around said waist portion, said first tunnel cloth portion being communicated with corresponding said second tunnel cloth portion;

a string passing through said first and second tunnel cloth portions, said string being fixed at its one end to a lower end of said first tunnel cloth portion and pulled outward from an end of said second tunnel cloth portion.

2. The sportswear as claimed in claim 1, wherein said back support piece is formed in substantially elongated bell shape having a length corresponding to a wearer's back from his waist portion up to neck portion.

3. The sportswear as claimed in claim 1, wherein said suspenders are detachably engaged with a pair of front support pieces provided to said waist portion by means of clips.

4. The sportswear as claimed in claim 1, wherein said pants are of overall type.

5. The sportswear as claimed in claim 1, further comprising a jacket portion integrally formed with said pants.

6. Sportswear as claimed in claim 5, said jacket portion includes tunnel cloth portions provided along both sleeves of said jacket portion, and strings each fixed at its one end to one end of each said tunnel cloth portion and fastening up at its other end at a desired portion to the other end of each said tunnel cloth portion thereby adjusting length of said sleeves.

7. The sportswear as claimed in claim 5, wherein said jacket portion includes fastening means provided around each sleeve of said jacket portion at its intermediate position at desired intervals thereby adjusting length of said sleeve.

8. The sportswear as claimed in claim 1, further comprising a support members provided at a junction of said first and second tunnel cloth portions for enabling said string to be pulled smoothly.

9. The sportswear as claimed in any one of claims 1 and 8, wherein said pants comprise fastening means provided between two leg portions from their bottom to the crotch thereby allowing said pants to be opened and closed under said leg portions.

10. The sportswear as claimed in any one of claims 1, and 8, wherein said pants further comprise an inner backing cloth attached to the back face of each said leg portion below knee position, said inner backing cloth having a rectangular shape in a developed state and a height substantially corresponding to a height of the knee position and being adapted to be opened and closed.

11. The sportswear as claimed in claim 10, wherein an upper edge of said inner backing cloth is fixed by sewing to the back face of each said leg portion under the knee position while its lower edge is provided with a rubber containing tightening band with fastening means at both ends thereof.

* * * * *